US011320120B2

(12) United States Patent
Gongola et al.

(10) Patent No.: US 11,320,120 B2
(45) Date of Patent: May 3, 2022

(54) ELEVATED AIRFIELD LIGHT FIXTURE

(71) Applicant: EATON INTELLIGENT POWER LIMITED, Dublin (IE)

(72) Inventors: Paul Gongola, Enfield, CT (US); Oluwole Godfred Oyelola, Jr., Tolland, CT (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/054,805

(22) PCT Filed: May 10, 2019

(86) PCT No.: PCT/EP2019/025145
§ 371 (c)(1),
(2) Date: Nov. 12, 2020

(87) PCT Pub. No.: WO2019/219244
PCT Pub. Date: Nov. 21, 2019

(65) Prior Publication Data

US 2021/0148549 A1 May 20, 2021

Related U.S. Application Data

(60) Provisional application No. 62/671,148, filed on May 14, 2018.

(51) Int. Cl.
*F21V 17/10* (2006.01)
*F21V 19/00* (2006.01)
(Continued)

(52) U.S. Cl.
CPC ..... *F21V 17/104* (2013.01); *F21V 19/003* (2013.01); *F21V 31/005* (2013.01);
(Continued)

(58) Field of Classification Search
CPC .... F21V 17/104; F21V 19/003; F21V 31/005; F21Y 2107/90; F21Y 2115/10
See application file for complete search history.

(56) References Cited

U.S. PATENT DOCUMENTS 9,863,629 B2 * 1/2018 Doyle ..... F21V 29/56
2006/0120083 A1 6/2006 Trojanowski et al.
(Continued)

FOREIGN PATENT DOCUMENTS

EP 2808261 A1 12/2014
EP 2903298 A1 8/2015
JP 2008210647 A 9/2008

OTHER PUBLICATIONS

International Search Report issued in corresponding application No. PCT/EP2019/025145 dated Oct. 23, 2019, 4 pages.
(Continued)

*Primary Examiner* — Anabel Ton
(74) *Attorney, Agent, or Firm* — Pearne & Gordon LLP

(57) ABSTRACT

There is provided an elevated light fixture that includes a frangible coupling designed to secure the fixture to the ground, a housing designed to be affixed to the frangible coupling and house and/or support additional features of the light fixture, a cap to lock the globe atop the housing by engaging a component of the housing or a support component that is affixed to the housing, lighting components designed to emit light such as an LED as well as a lens designed to sit atop the housing when assembled that is transparent or translucent to allow light from the lighting components to pass through, electronic components designed to deliver electricity to the lighting components such as a circuit card and a power cord, and support components that support the lighting and/or electrical components such as a parts retainer flange.

19 Claims, 10 Drawing Sheets

(51) Int. Cl.

| | |
|---|---|
| ***F21V 31/00*** | (2006.01) |
| *F21Y 107/90* | (2016.01) |
| *F21Y 115/10* | (2016.01) |
| *F21W 111/06* | (2006.01) |

(52) U.S. Cl.
CPC ..... *F21W 2111/06* (2013.01); *F21Y 2107/90* (2016.08); *F21Y 2115/10* (2016.08)

(56) References Cited

U.S. PATENT DOCUMENTS

2015/0285449 A1* 10/2015 Hajee ..... F21V 21/005
362/183
2017/0184257 A1 6/2017 Belitz

OTHER PUBLICATIONS

Written Opinion issued in corresponding application No. PCT/EP2019/025145 dated Oct. 23, 2019, 10 pages.

* cited by examiner

ELEVATED AIRFIELD LIGHT FIXTURE

CROSS REFERENCE TO RELATED APPLICATIONS

This application is a national stage application, filed under 35 U.S.C. 371, of International Patent Application No. PCT/EP2019/025145 filed on May 10, 2019, which claims the benefit of U.S. Provisional Patent Application No. 62/671,148 filed on May 14, 2018, each of which is incorporated by reference herein in its entirety.

BACKGROUND

Field

The present disclosure relates to an elevated airfield light fixture, for example a light fixture especially suitable for use as a runway or taxiway edge light at an airfield or for use as heliport perimeter light.

Description of the Related Art

To provide markers for airfield runways and taxiways as well as heliports, it is customary to employ elevated light fixtures along the edges of runways and taxiways to facilitate guidance of aircraft, for example during take-off, landing, and taxiing operations. Conventional runway and taxiway elevated edge light fixtures and heliport perimeter light fixtures typically include an upright support member or pedestal with a lamp assembly and a cover such as a prismatic globe mounted at its upper end. The support member is engageable at its lower end with a receptacle mounted in or adjacent to the runway, taxiway, or heliport perimeter. The globe provides a protective cover for the lamp assembly and can be optically configured as a lens to transmit light in a predetermined direction.

There are downsides to the existing light fixtures, such as the number of components, the amount of machining required to make the components, and the time required to assemble or perform maintenance on the fixtures. Described herein are improved elevated airfield and heliport perimeter light fixtures designed to alleviate some downsides of existing fixtures.

SUMMARY

The following presents a simplified summary in order to provide a basic understanding of the embodiments described herein. This summary is not an extensive overview nor is it intended to identify key or critical elements. Its sole purpose is to present some concepts in a simplified form as a prelude to the more detailed description that is presented later.

There is provided an elevated light fixture that includes a frangible coupling designed to secure the fixture to the ground, a housing designed to be affixed to the frangible coupling and house and/or support additional features of the light fixture, a cap to lock the globe atop the housing by engaging a component of the housing or a support component that is affixed to the housing, lighting components designed to emit light such as an LED as well as a lens designed to sit atop the housing when assembled that is transparent or translucent to allow light from the lighting components to pass through, electronic components designed to deliver electricity to the lighting components such as a circuit card and a power cord, and support components that support the lighting and/or electrical components such as a parts retainer flange.

Other features and aspects will be apparent from the following detailed description, the drawings, and the claims.

BRIEF DESCRIPTION OF THE FIGURES

Throughout the drawings and detailed description, unless otherwise described, the same drawing reference numerals can be understood to refer to the same elements, features, and structures. The relative size and depiction of these elements may be exaggerated for clarity, illustration, and convenience.

DETAILED DESCRIPTION

Figure 1:
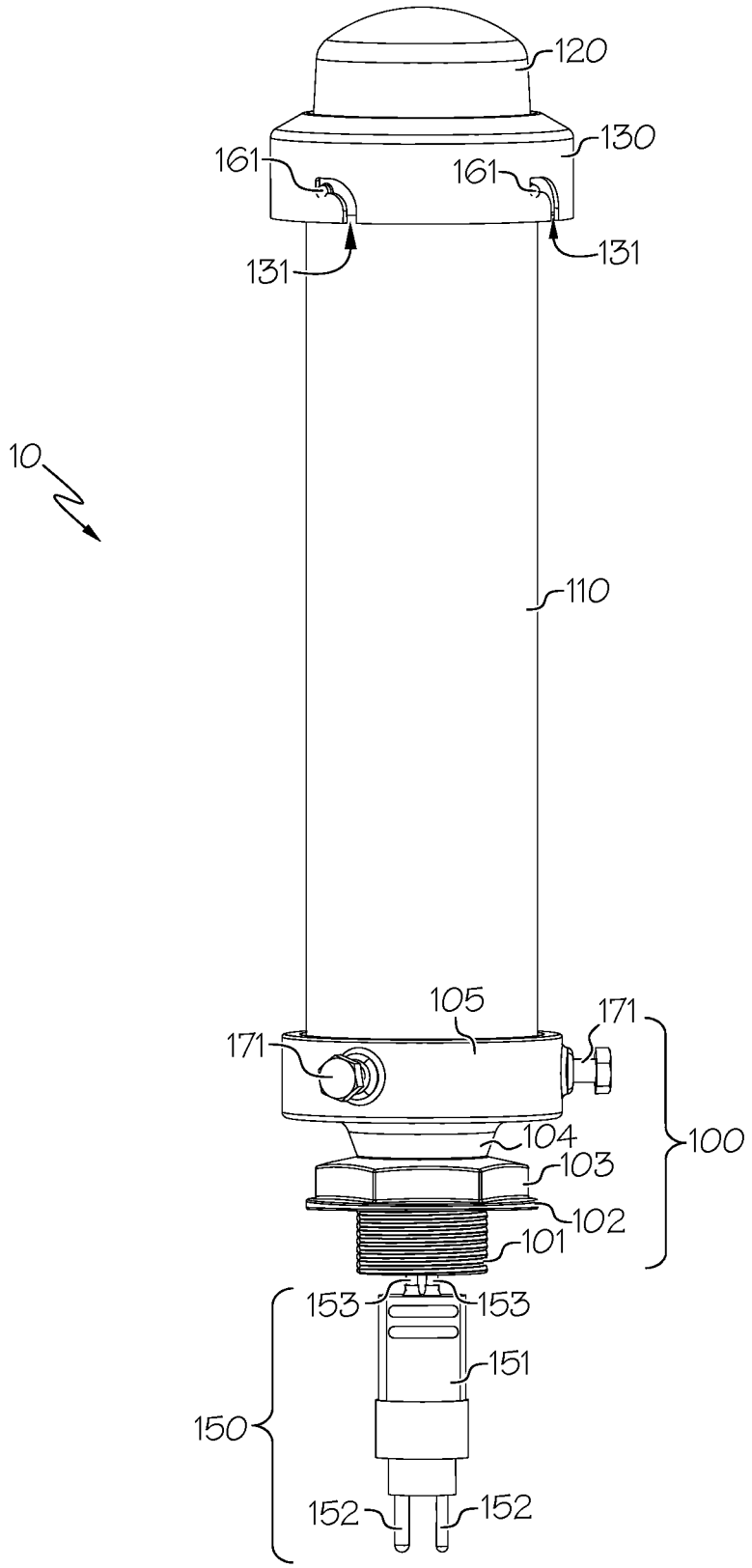
FIG. 1 shows a side view of a light fixture in accordance with an example embodiment.

Example embodiments are described and illustrated herein. These illustrated examples are not intended to be a limitation on the present embodiments. For example, one or more aspect of the light fixture can be used in other embodiments and other types of fixtures. Example embodiments of an airfield light fixture will be described more fully hereinafter with reference to the accompanying drawings. Such examples may, however, be embodied in many different forms and should not be construed as limited to the embodiments set forth herein. Like, but not necessarily the same, elements in the various figures are denoted by like reference numerals for consistency. Terms such as top, bottom, inner, outer, upper, lower, etc. are used merely to distinguish one component (or part of a component or state of a component) from another. Such terms are not intended to denote a preference or a particular orientation.

Figure 2:
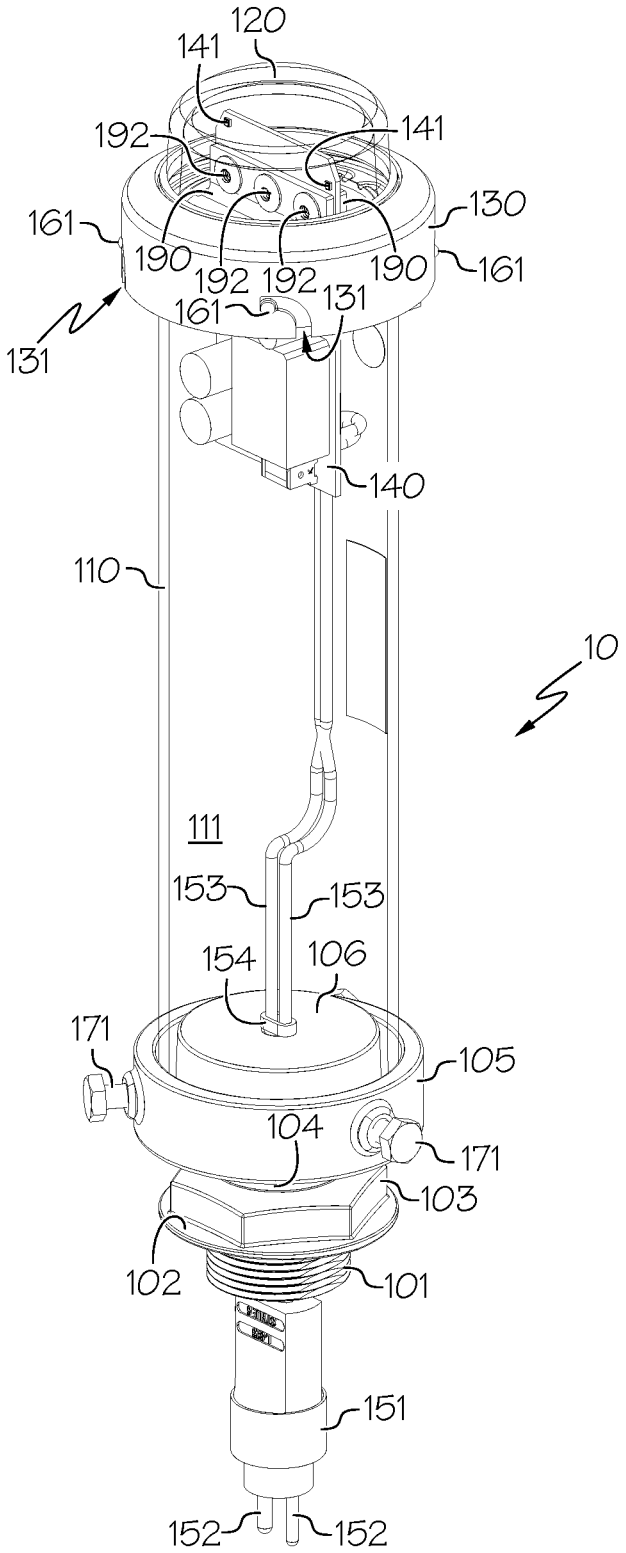
FIG. 2 shows a side angled isometric view of a light fixture with certain features removed so that additional features may be viewed in accordance with an example embodiment.

As shown in the figures, one example embodiment of an airfield light fixture 10 can include a frangible coupling 100, a housing 110, a lens in the form of globe 120, a cap 130, electronic components including a circuit card 140 as well as a power cord 150, a parts retainer flange 160, and a gasket 180. Turning to FIGS. 1-2, the frangible coupling 100 includes, from bottom to top, an engagement member 101, a shoulder 102, a hex portion 103, an intermediate portion 104, and a receiving member 105 having an outer surface 105*a* and an inner surface 105*b* (see FIGS. 6A-6B). The inner surface 105*b* in part defines a receiving portion 107 of the frangible coupling 100 (see FIGS. 6A-6B), which is the area in which the housing 110 of the fixture 10 can be positioned or otherwise engaged to the frangible coupling 100.

The engagement member 101 of the frangible coupling 100 is generally annular shaped and extends downward from the shoulder 102, which can also be generally annular shaped. As shown, the engagement member 101 is threaded such that it can be mated with a threaded receiver (not shown) in the ground or in a receptacle (not shown) in the ground. The shoulder 102 serves as the visible bottom of the light fixture 10 when assembled and received in the ground/receptacle. However, in alternative embodiments, the engagement member 101 can be designed to be affixed to a receiver with other means such that it need not be threaded. The hex portion 103 extends upwards from the shoulder 102 and has a generally hexagonal prism shape. The hexagonal shape of the hex portion 103 provides a surface that a tool can engage such that the fixture 10 can be secured within the ground. Additionally, the hexagonal shape of the hex portion 103 provides strength to the bottom of the frangible coupling 100. It is to be appreciated that the hexagonal shape is just an example and that the hex portion 103 can be of any suitable shape. The intermediate portion 104 extends upwards from the hex portion 103 and has a generally parabolic shape with the cross-sectional perimeter increasing in the upwards direction. Thus, the narrowest cross section of the intermediate portion 104 is at its base where it meets the hex portion 103. The junction of the intermediate portion 104 and the hex portion 103 serves as a fracture point 104*a* for the frangible coupling 100 (see FIGS. 6B-7). It is to be appreciated that the narrowing of the frangible coupling 100 coming from both directions of the fracture point 104*a* facilitates the breaking of the frangible couple 100 at this fracture point 104*a* when a requisite force is exerted on the upper components of the light fixture 10, e.g. being contacted by a moving object on a runway. The receiving member 105 sits atop the intermediate portion 104 and has a generally annular shape. As can be seen in FIG. 2 and in greater detail in FIGS. 6A-6B, a boss 106, which can also be annularly shaped, is positioned within a central area of the receiving member 105. A bottom surface 108 connects the outer diameter of the receiving member 105 to the boss 106. The boss 106 includes a side surface 106*a*, a top surface 106*b* and an opening 106*c* to provide access to a hollow interior cavity 109 of the frangible coupling 100. The hollow interior cavity 109 extends through the frangible coupling 100 to a bottom opening (see FIGS. 6B-7) in the engagement member 101. The hollow interior cavity 109 is defined by a continuous inner surface of the frangible coupling 100 but for a ring 104*b* (see FIGS. 6B-7). This inner ring 104*b* is located at an inner position corresponding to the fracture point 104*a* of the frangible coupling 100, and has a wider diameter of than the hollow interior cavity 109 to help ensure that the frangible couple 100 breaks at the fracture point 104*a* upon being contacted by the requisite force. The inner surface 105*b* of the receiving member, the side surface 106*a* of the boss 106, and the bottom surface 108 together define the receiving portion 107 of the frangible coupling 100.

Figure 3:
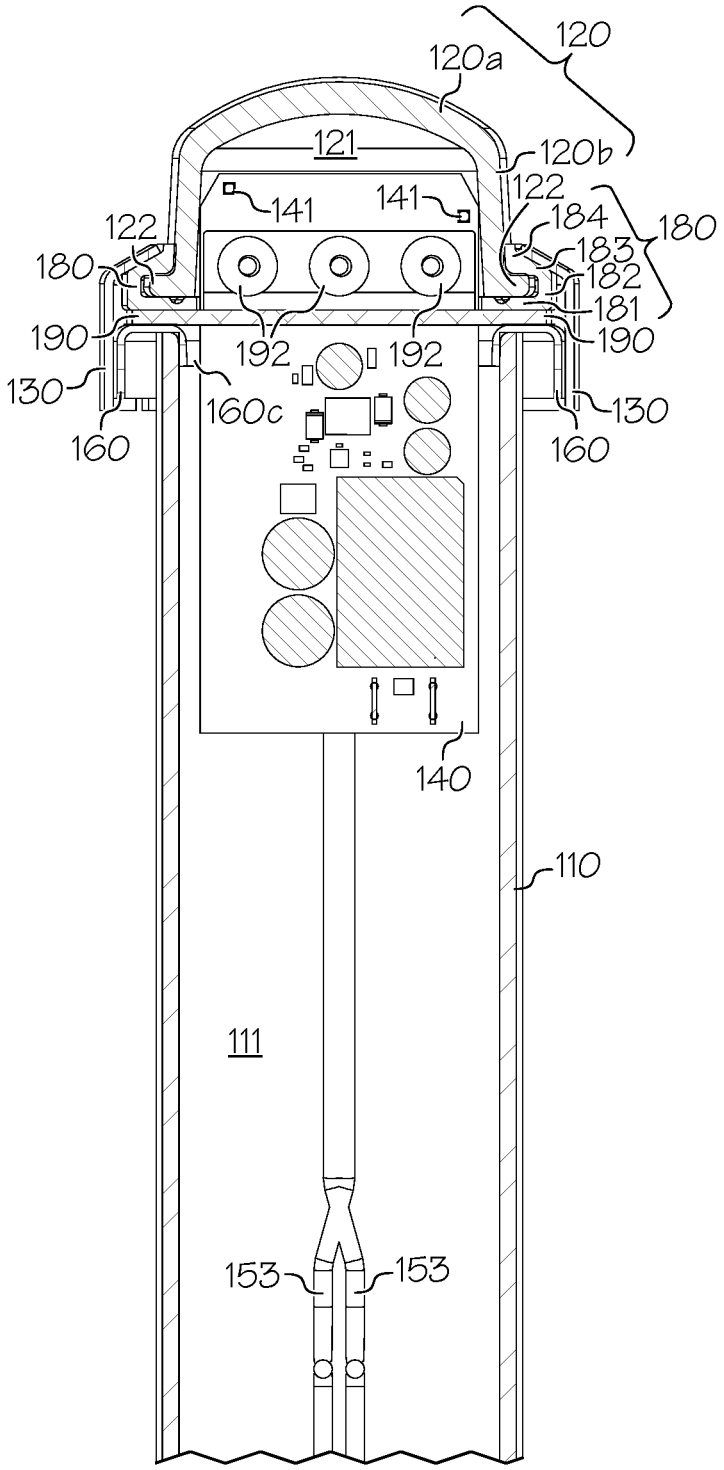
FIG. 3 shows a first side cross-sectional view of upper features of a light fixture in accordance with an example embodiment.

Turning back to FIGS. 1-2, the housing 110 is formed as a column having a generally annular cross section. The housing 110 has a hollow interior cavity 111 extending therethrough that is generally cylindrically shaped and is open at the top and bottom of the housing 110. The lower end of the housing 110 is shaped and dimensioned such that it can be inserted into and received by the receiving portion 107 of the frangible coupling 100. FIG. 3 depicts the housing 110 transparently to show it being received within the frangible coupling 100 to depict one example of how the housing 110 can connect with the frangible coupling 100.

Figure 6A:
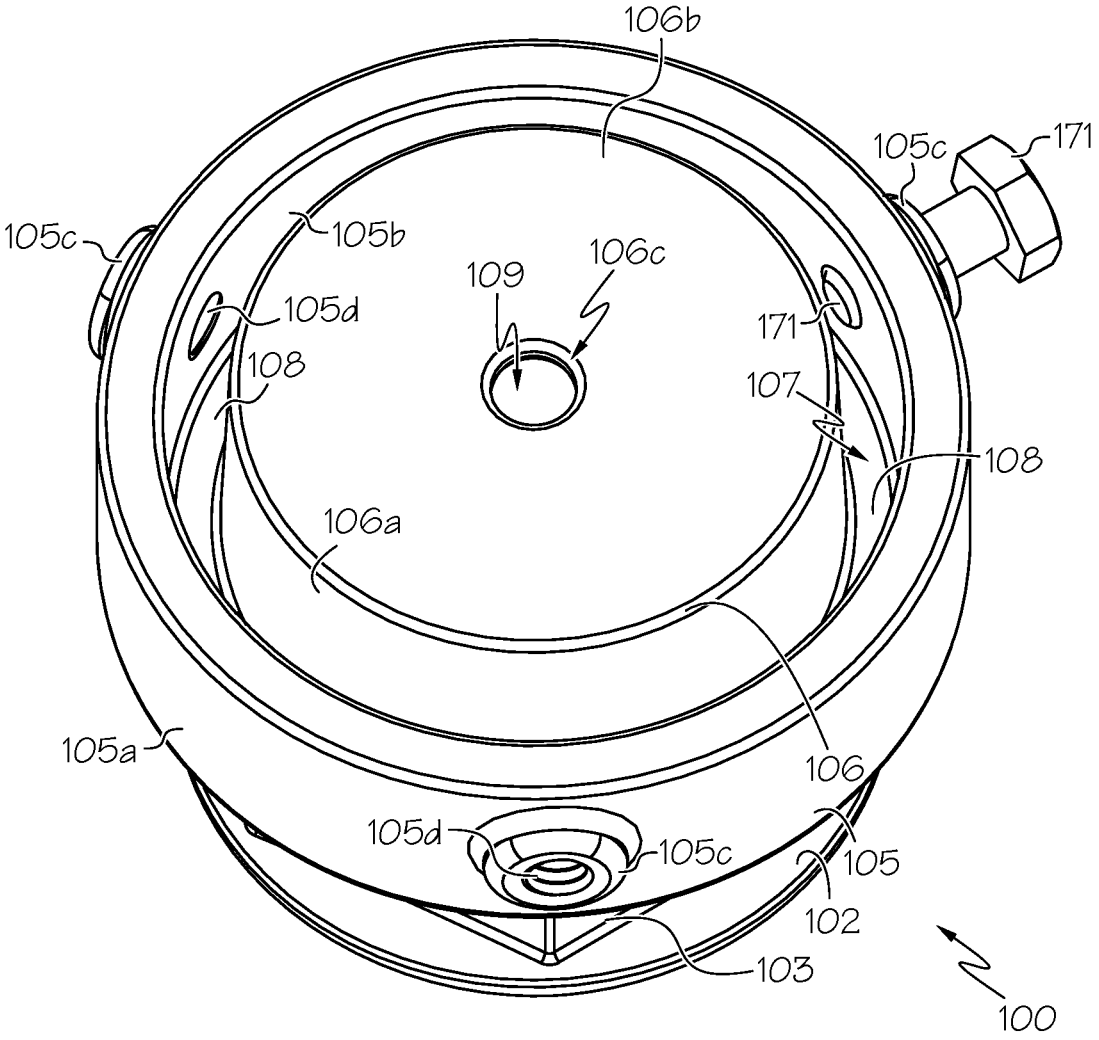
FIG. 6A shows a side angled isometric view of a frangible coupling of a light fixture in accordance with an example embodiment.
Figure 6B:
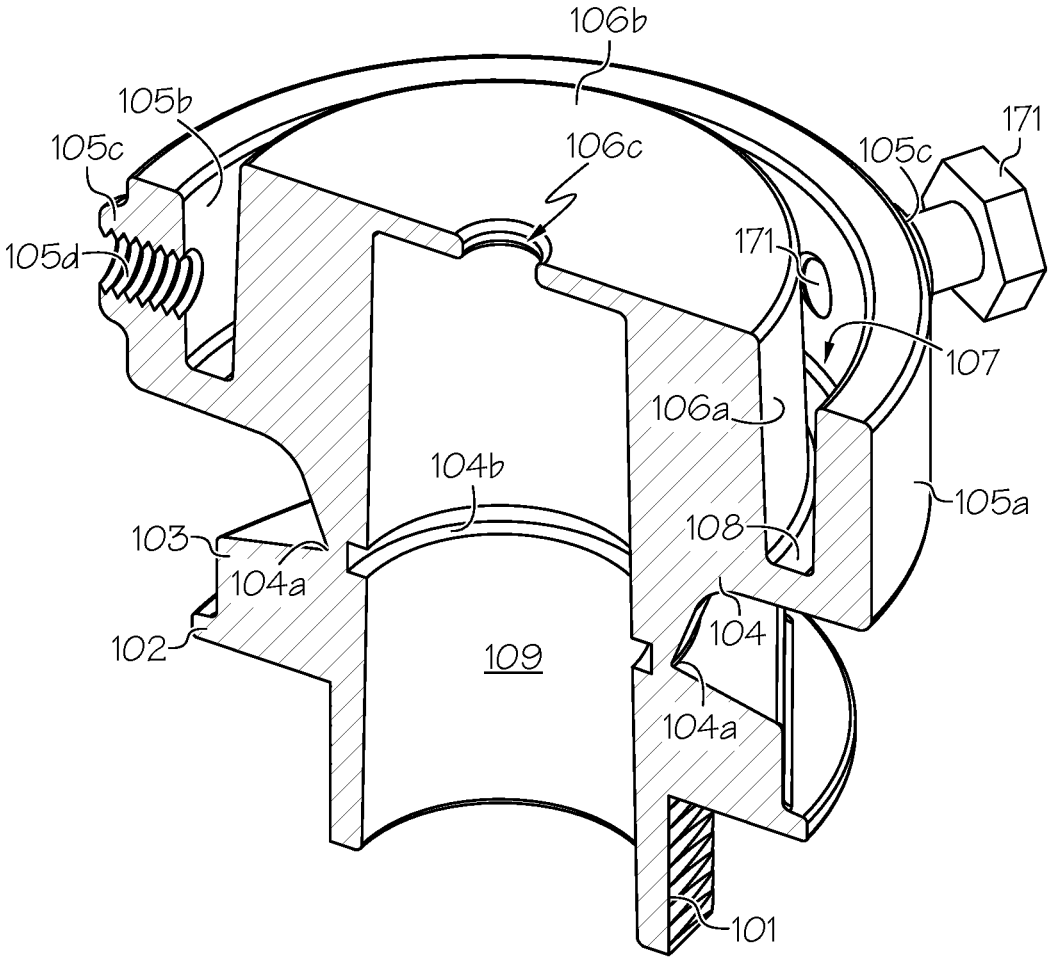
FIG. 6B shows a side angled cross-sectional view of a frangible coupling of a light fixture in accordance with an example embodiment.
Figure 7:
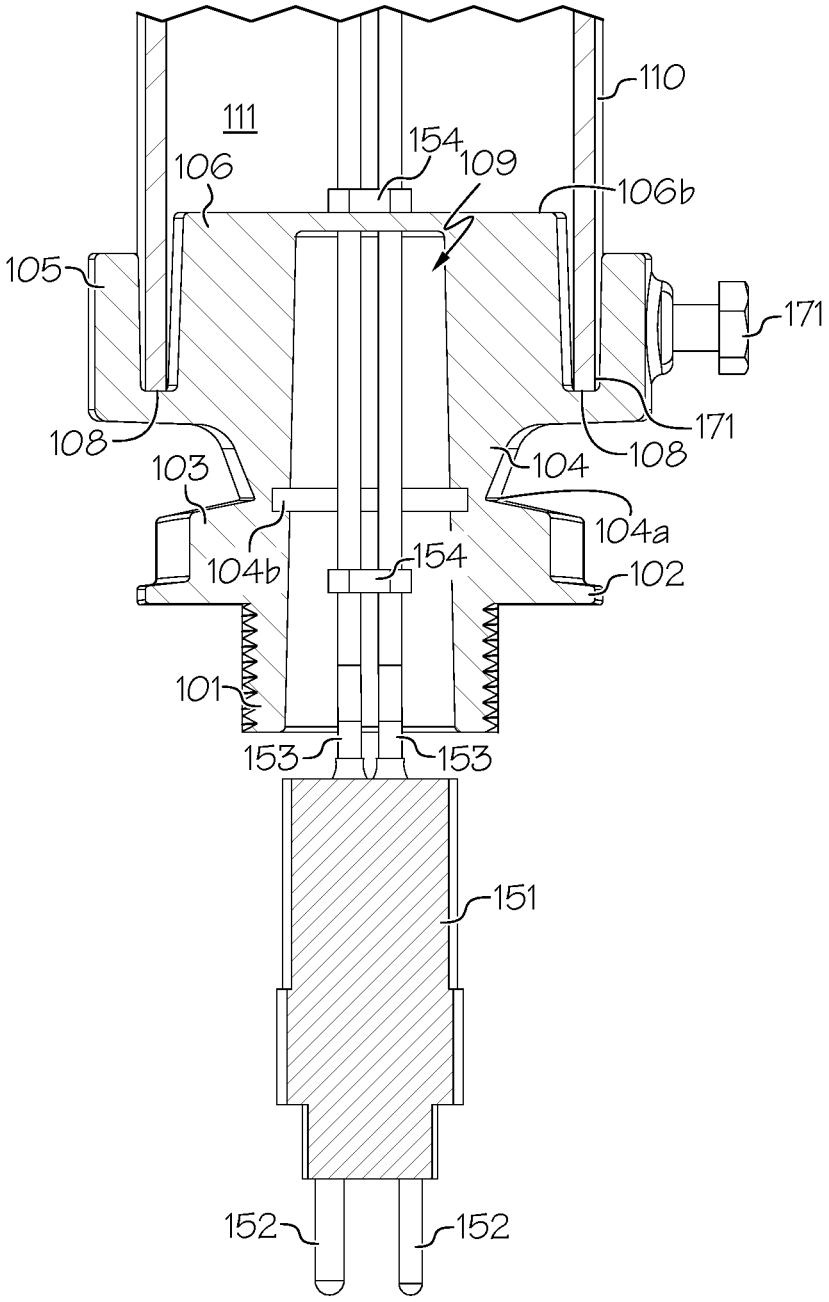
FIG. 7 shows a side cross-sectional view of lower features of a light fixture in accordance with an example embodiment.

Referring to FIGS. 6A-7, the receiving member 105 of the frangible coupling 100 has projected portions 105*c* that fastener holes 105*d* extend through. The fastener holes 105*d* receive fasteners 171 to secure the housing 110 in place inside the receiving portion 107. For example, with the housing 110 positioned within the receiving portion 107 of the frangible coupling, suitable fasteners 171, such as set screws, can be used to secure the housing 110 in place. Alternatively, the housing 110 can include fastener holes (not shown) that align with the fastener holes 105*d* such that each fastener 171 can be inserted through a fastener hole 105*d* the corresponding fastener hole in the housing 110. In alternative embodiments, any other suitable method of securing the housing to the frangible coupling can be employed.

As shown in FIGS. 2 and 7, the frangible coupling 100 and housing 110 are configured such that the power cord 150 can extend from the bottom opening of the engagement member 101 through the hollow interior cavity 109 of the frangible coupling 100 and out of the opening 106*c* in the boss 106. The power cord 150 also extends through the hollow interior cavity 111 of the housing 110 such that it can be coupled to the circuit card 140, as described in greater detail below. The power cord 150 includes a cord base 151 from which two pins 152 extend downward from the bottom thereof. The cord base 151 can be gripped such that the pins 152 can be inserted into an electrical outlet (not shown) to establish an electrical connection for the light fixture 10. Extending from the top of the cord base 151 are two leads 153, which when assembled, extend through the hollow interior cavity 109 of the frangible coupling 100 and the hollow interior cavity 111 of the housing 110 such that they can be connected to the circuit card 140 for delivering electricity thereto, as described in greater detail below. The pins 152 can be electrically connected to the leads 153 inside the cord base 151.

Referring to FIG. 7, in order to prevent the power cord 150 from damaging the electrical outlet when the light fixture 10 is damaged (e.g., broken at the fracture point 104*a* of the frangible coupling 100), the light fixture 10 can include strain relief components 154. As depicted, two cable ties 154 are wrapped around the leads 153 to serve as strain relief components 154. The cable ties 154 are configured to be larger than the opening 106*c* in the boss 106 such that they cannot pass from one side of the opening 106*c* to the other. A first cable tie 154 is secured to the leads 153 on the top side of the opening 106*c* adjacent the top surface 106*b* of the boss 106. A second, lower cable tie 154 is secured to the leads 153 below the opening 106*c*. When the light fixture 10 is broken at the fracture point 104*a*, the movement of the upper portion of frangible coupling 100 and therefore boss 106 causes the upper surface 106*b* surround the opening 106*c* to pull in the upper cable tie 154 in a direction away from the electrical outlet (not shown) that the pins 152 are plugged in to. Because the upper cable tie 154 is secured to the leads 153, the portion of the leads 153 between the upper cable tie 154 and lower cable tie 154 exerts a force on the portion of the leads 153 secured by the lower cable 154. The portion of the leads 153 between the lower cable tie 154 and the cord base 151 exerts a force on the cord base 151, resulting in the cord base 151 and pins 152 being pulled out of and away from the electrical outlet such that it is not damaged.

Figure 8:
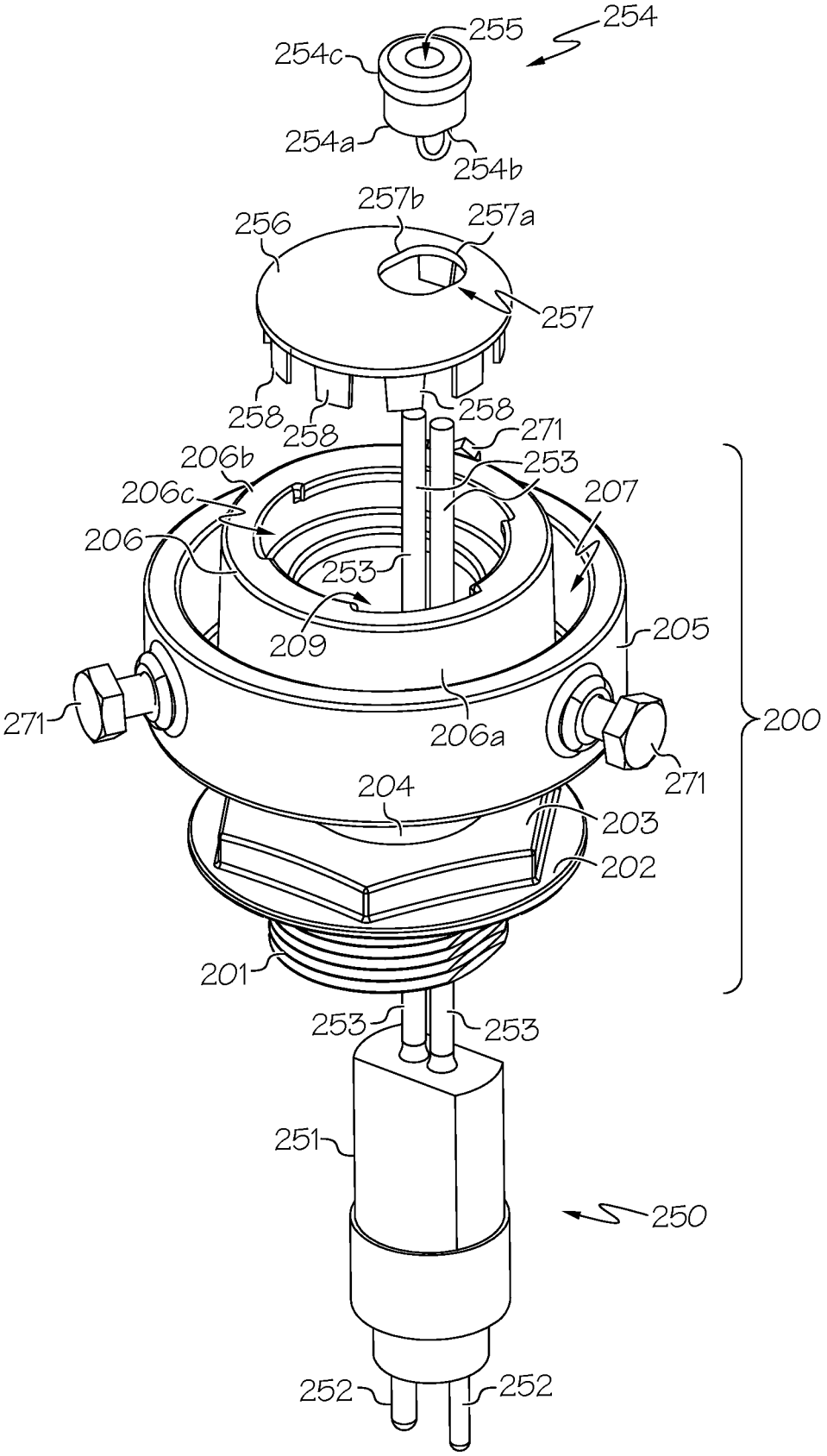
FIG. 8 shows an exploded side isometric view of a light fixture with the upper features removed such that the details of a frangible coupling of the light fixture may be viewed in accordance with an example embodiment.
Figure 9:
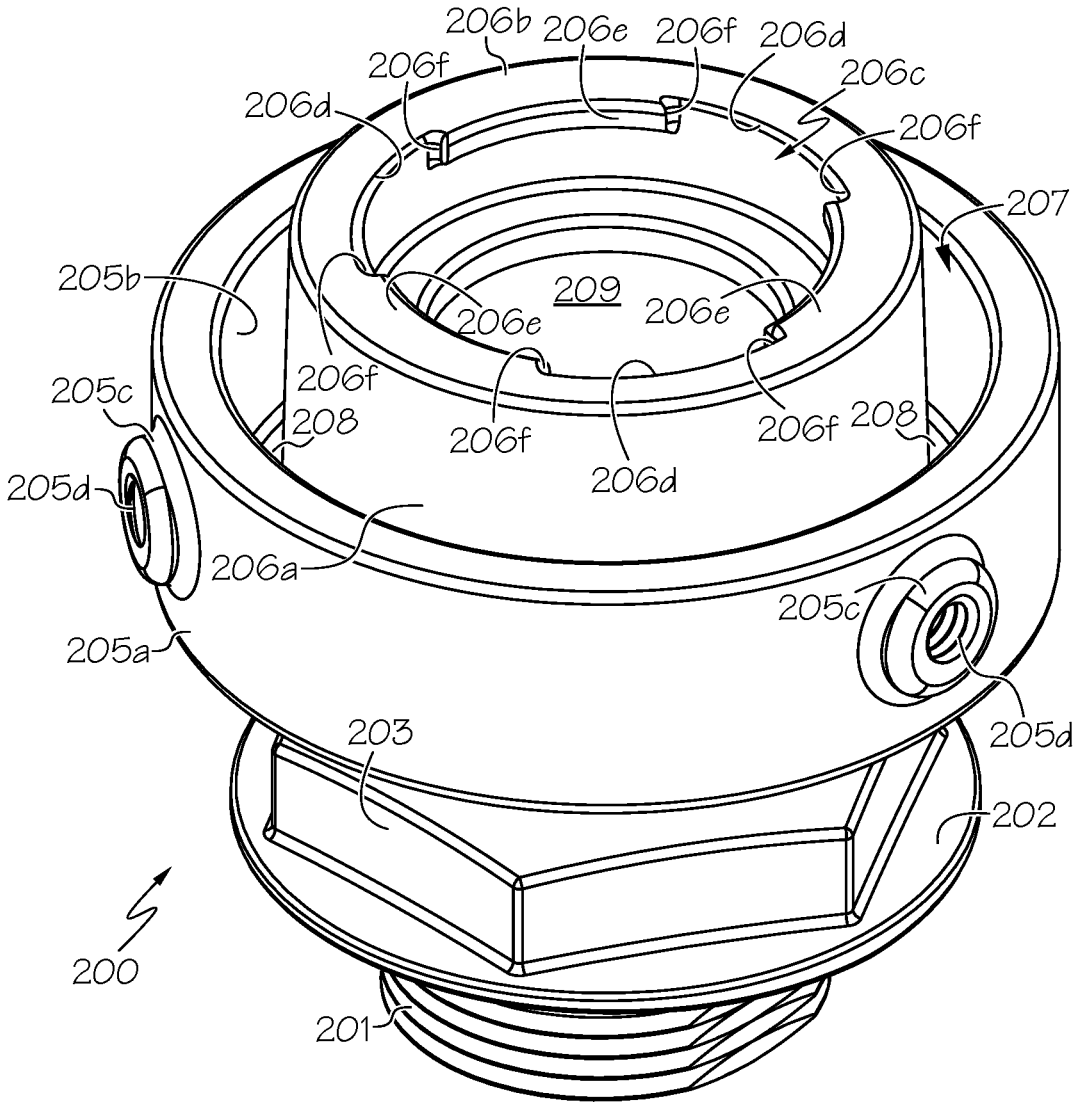
FIG. 9 shows a side isometric view of a frangible coupling of a light fixture in accordance with an example embodiment.

In a second embodiment shown in FIGS. 7-8, a frangible coupling 200 is provided. Similar to the frangible coupling 100, the frangible coupling 200 includes a lower portion 201, a shoulder 202, a hex portion 203, an intermediate portion 204, a receiving member 205 having fastener holes 205*d* for receiving fasteners 271 and a boss 206, a receiving portion 207, a connection portion 208, and an opening 206*c* in the top surface 206*b* of the boss 206 to provide access to a hollow interior chamber 209. The second embodiment includes a strain relief fitting 254 as a strain relief component having a hole 255 that the leads 253 of the power cord 250 can pass through. The strain relief fitting 254 is shaped and dimensioned to be received in a strain relief retainer 256 which itself is shaped and dimensioned to be received in the opening 206*c* of the boss 206 of the frangible coupling 200. Specifically, the strain relief retainer 256 has a hole 257 shaped and dimensioned to securely receive the strain relief fitting 254. The strain relief fitting 254 has two rounded sides 254*a* and two flat sides 254*b*. Similarly, the hole 257 of the strain relief retainer 256 has two rounded sides 257*a* and two flat sides 257*b* which are shaped and dimensioned to securely receive the strain relief fitting 254. With this configuration, it is to be appreciated that the strain relief fitting 254 cannot rotate within the strain relief retainer 256. Thus the leads 253 cannot become twisted as a result of the strain relief fitting 254 rotating, preventing the leads 253 from being damaged by such twisting. Alternatively, other configurations of the strain relief fitting 254 and strain relief retainer 256 can be utilized to prevent the rotation of the fitting 254. Additionally, the strain relief fitting 254 includes an upper portion 254*c* that is wider than the opening 206*c* such that it cannot pass through the opening.

Figure 5:
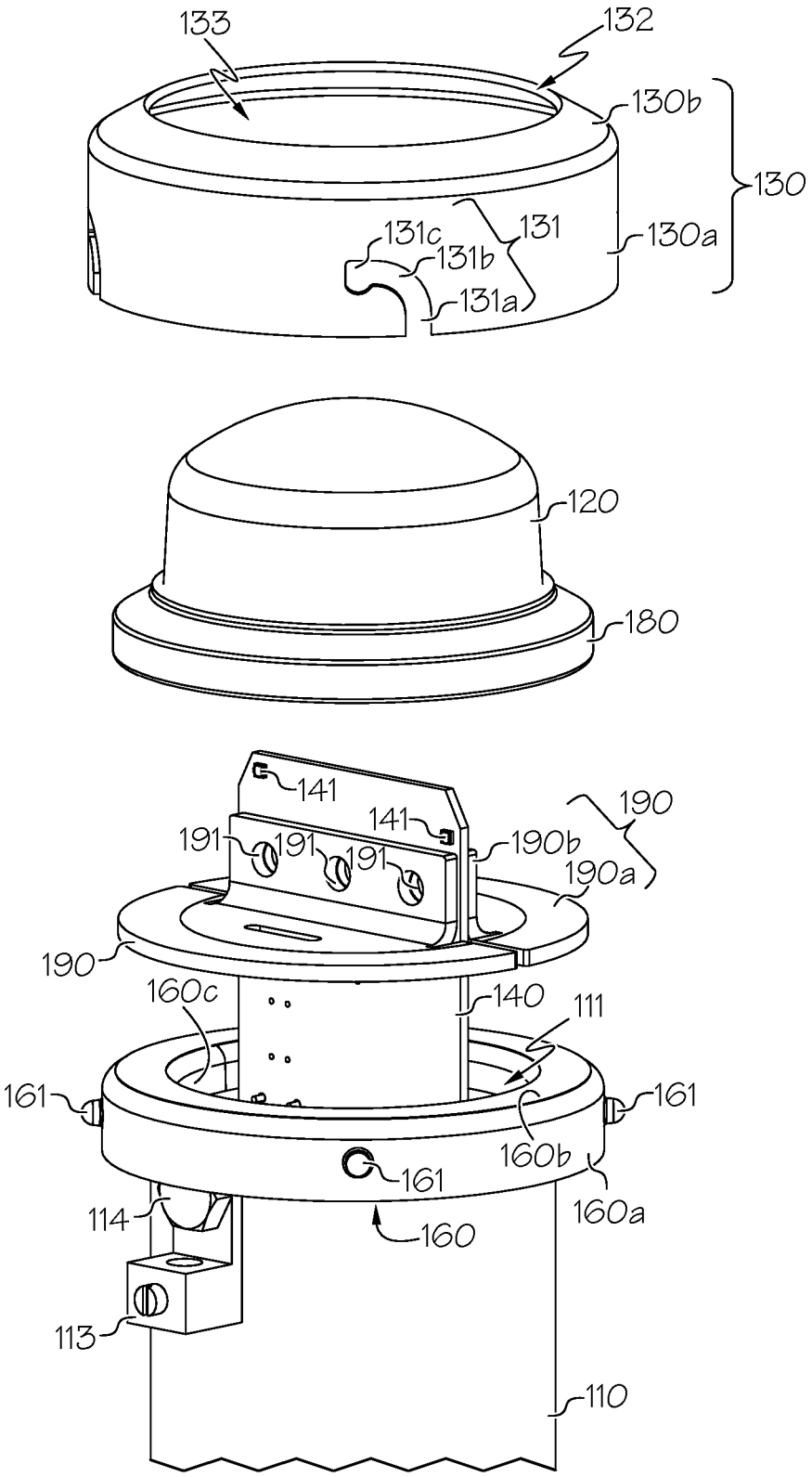
FIG. 5 shows an exploded side angled isometric view of upper features of a light fixture in accordance with an example embodiment.

As mentioned above, the strain relief retainer 256 is designed to be received in the frangible coupling 200. Specifically, the strain relief retainer 256 is shaped and dimensioned be received in the opening 206*c* in the top surface 206*b* of the boss 206 of the frangible coupling 200. The top of the strain relief retainer 256 is generally circular shaped with several tabs 258 extending downwardly therefrom. The tabs 258 are designed such that when the strain relief retainer 256 is inserted into the opening 206*c*, the tabs 258 are forced inwards by the walls 206*d* of the top surface 206*b* of the boss 206 that define the opening 206*c*. The tabs 258 are elastic such that, upon being bent inward, they exert an outward force against the walls 206*d* such that the strain relief retainer 256 is secured within the opening 206*c*. To prevent the strain relief retainer 256 from rotating significantly within the opening 206*c* which would in turn rotate the leads 253 in the strain relief fitting 254, the walls 206*d* include inwardly-extending tabs 206*e*. As depicted in FIG. 5, there are three tabs 206*e* spaced and dimensioned such that the opening 206*c* is defined by alternating sections of walls 206*d* and tabs 206*e*. The junctions of walls 206*d* and tabs 206*e* create shoulders 206*f* that the tabs 258 of the strain relief retainer 256 that are pressed up against the walls 206*d* cannot rotate past, thus limiting the rotation of the strain relief retainer 256. Alternatively, other configurations of the strain relief retainer 256 and opening 206*c* can be utilized to prevent the rotation of the retainer 256.

To prevent the power cord 250 from damaging the electrical outlet when the light fixture is damaged (i.e., provide strain relief), the length of leads 253 from the strain relief fitting 254 to the cord base 251 is limited such that little or no slack is provided when the pins 252 are received in an electrical outlet. With the leads 253 secured in the strain relief fitting 254 and the length of the leads 253 from the electrical outlet to the strain relief fitting 254 minimized, any force that results in the strain relief fitting 254 being drawn away from the electrical outlet results (e.g., the frangible coupling 200 breaking at the fracture point) in the pins 252 being drawn out of the electrical outlet. This assists in preventing damage to the electrical outlet, for example as a result of the pins 252 becoming bent with respect to the cord base 251.

Returning to the first embodiment and referring to FIGS. 2-5, the opposite end of the housing 110 that is inserted into the frangible coupling 100 supports the globe 120, the cap 130, the circuit card 140 (via brackets 190, described below), the parts retainer flange 160, and the gasket 180. The parts retainer flange 160 has a generally annular shape with an outer side wall 160*a*, a top wall 160*b*, and an inner side wall 160*c* all having generally annular shapes. The parts retainer flange 160 defines a central opening. The parts retainer flange 160 is coupled with the housing 110 by inserting the inner side wall 160*c* into the hollow interior cavity 111 of the housing 110 until the underside of the top wall 160*b* rests on the wall of the housing 110. The inner side wall 160*c* of the parts retainer flange 160 is elastically connected to the top wall 160*b* thereof such that inserting the inner side wall 160*c* into the hollow interior cavity 111 of the housing 110 causes the inner side wall 160*c* to be inwardly flexed by the walls of the housing 110. The elastic force of the inner side wall 160*c* acts in a direction towards the walls of the housing 110 such that the parts retainer flange 160 is secured to the top of the housing 110 via a press fit connection. In alternative embodiments, the parts retainer flange 160 can be secured to the housing 110 with a variety of means, including but not limited to, fasteners, welding, crimping, glue, or chemical bonding. Additionally, in alternative embodiments the inner side wall 160*c* can include tabs similar to those of the tabs 258 of the strain relief retainer 256. The outer side wall 160*b* includes a plurality of projections 161 that extending outwardly therefrom. As will be discussed in greater detail below, these projections 161 help secure the cap 130 to the light fixture 10.

Figure 4:
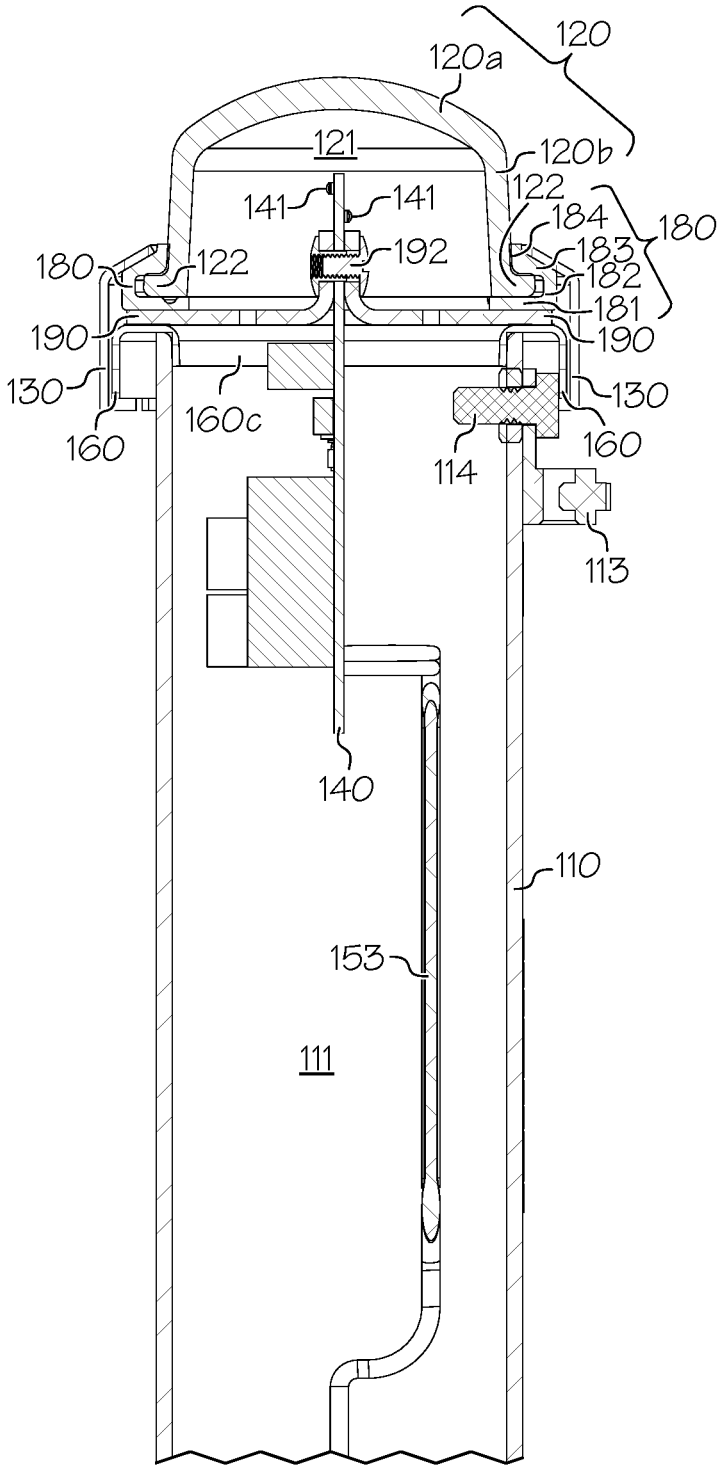
FIG. 4 shows a second side cross-sectional view of upper features of a light fixture in accordance with an example embodiment.

As can be seen in FIG. 4, near the top of the housing 110 is a fastener hole (not numbered) for receiving fastener 114 to secure a ground lug 113 to the light fixture 10. In alternative embodiments, the parts retainer flange 160 can include a portion that extends past the fastener hole of the housing 110. This portion can itself include a corresponding fastener hole such that the fastener 114 assists in securing the parts retainer flange 160 to the housing 110.

The circuit card 140 includes electronic sub-components that, upon being connected to a power source, can power lighting components 141, such as LEDs. The circuit card 140 is supported by the parts retainer flange 160. Specifically, the circuit card 140 is secured to two brackets 190 which rest on top of the top wall 160*b* of the parts retainer flange 160. Referring to FIG. 5, the brackets 190 include a horizontal section 190*a* connected to a vertical section 190*b*. The vertical sections 190*b* include fastener holes 191 for receiving fasteners 192, which secure the circuit card 140 to the brackets 190. Specifically, a fastener 192 is inserted through the fastener hole 191 in one bracket 190, then through a fastener hole (not explicitly shown) in the circuit card 140, and then through the fastener hole 191 in the other bracket 190 thereby securing the circuit card 140 to both brackets 190. When assembled with the brackets 190, the circuit card 140 can then be partially inserted into the hollow interior cavity 111 of the housing 110 from above. The horizontal sections 190*a* of the brackets 190 rest on top of the top wall 160*b* of the parts retainer flange 160. Alternatively, other configurations can be provided for supporting the circuit card 140 in the housing 110. The circuit card 140 is connected to the leads 153 of the power cord 150. Thus, the circuit card 140 can be powered via the power cord 150 such that the lighting components 141 can be powered and illuminated.

As can be seen in FIGS. 3-4, the globe 120 and gasket 180 are also supported by the parts retainer flange 160. Specifically, the globe 120 is partially received in the gasket 180 which are then rested on top of the parts retainer flange 160 and the brackets 190. The globe 120 is sufficiently translucent or transparent for allowing light from the lighting components 141 to pass through and includes a top section 120*a* that has a domed shape and a side section 120*b* extending vertically downwards therefrom that it has a generally annular shape. The top section 120*a* and side section 120*b* partially enclose a hollow interior 121 that is open from the bottom. At the bottom end of the side section 120*b* is a lip 122 that extends in a generally horizontal direction therefrom. The lip 122 is designed to be received in the gasket 180 as described in more detail below. In alternative embodiments, other configurations can be used for connecting the globe 120 to the gasket 180. In further alternative embodiments, other shapes can be utilized as a lens 120 other than a globe.

The gasket 180 is generally annular shaped and includes a base section 181 that defines a central opening, a side section 182 that is generally vertical and extends upwards from the outer perimeter of the base section 181, an intermediate section 183 that extends diagonally upwards and inwards from the top of the side section 182, and a top section 184 that is generally vertical and extends upwards from the intermediate section 183. The base section 181, side section 182, and intermediate section 183 define a receiving portion (not numbered) designed to receive the lip 122 of the globe 120. For reasons discussed in more detail below, at least a portion of the gasket 180 is elastically flexible such that it returns to its resting position upon being stretched or compressed. For example, the gasket 180 can be elastically flexible such that if the intermediate section 183 is compressed towards the base section 181 from a resting position, it exerts a force to return to its resting position.

As can be seen in FIG. 5, the cap 130 includes a bottom section 130*a* that extends vertically and is generally annular shaped and defines a hollow interior 133, and a top section 130*b* that extends diagonally upwards and inwards from the top of the bottom section 130*a*. The top section 130*b* is also generally annular shaped and defines an upper opening 132 to the hollow interior 133. The cap 130 is shaped and dimensioned to fit over the top of the housing 110, the globe 120, the parts retainer flange 160, and the gasket 180 (see FIGS. 3-4). Specifically, the cap 130 can be inserted from above over these components such that the globe 120 extends through the hollow interior 133 and out through the upper opening 132. When assembled, the inner side of the top section 130*b* of the cap 130 rests against the outer side of the intermediate section 183 of the gasket 180 (see FIGS. 3-4). The bottom section 130*a* has locking channels 131 that are shaped and dimensioned for receiving the projections 161 of the parts retainer flange 160 when the cap 130 is inserted over the top of the housing 110, the globe 120, the parts retainer flange 160, and the gasket 180. Each of the locking channels 131 includes a first vertical section 131*a* that extends upwards from the bottom end of the bottom section 130*a*, an intermediate section 131*b* that extends at an angle left and upwards from the top ends of the first vertical sections 131*a*, and second vertical section 131*c* that extends downwards from the left ends of the intermediate section 131*b* but does not continue through to the bottom end of the bottom section 130*a*. When the cap 130 is inserted over the top of the light fixture 10, the projections 161 of the parts retainer flange 160 are each received within respective first vertical sections 131*a* of the cap 130. In order to lock the cap 130 in place, and accordingly lock the globe 120, circuit card 140/brackets 190, and gasket 180 in place, an external force is applied downwards on the cap 130 which forces the cap 130 downwards such that the projections 161 move from the first vertical sections 131*a*, into the intermediate sections 131*b*, and thereafter into the second vertical sections 131*c*. This downward force compresses the elastically flexible gasket 180, particularly forcing the intermediate section 183 downward toward the base section 181. Additionally, the shape of the locking channels 131 causes the cap 130 to rotate slightly with respect to the parts retainer flange 160. To lock the cap 130 in place, the downward external force applied on the cap 130 is removed, resulting in the elastically flexible gasket 180 forcing the cap 130 upwards such that the projections 161 move to the bottom ends of the second vertical sections 131*c* (see FIGS. 1-2), thus locking the cap 130 to the parts retainer flange 160 and thus the housing 110. The bottom ends of the second vertical sections 131*c* thus serve as locking positions for the projections 161. To unlock the cap 130, a downwards external force can be again applied and then the cap 130 rotated clockwise when viewed from above such that projections 161 move to the first vertical sections 131*a*, which allows the cap 130 to be lifted off the light fixture 10 due to the open bottom ends of the first vertical sections 131*a*. In alternative embodiments, in addition to the second vertical sections 131*c*, the locking channels can include additional vertical sections of varying depth such that the cap 130 can be locked on the light fixture 10 with varying degrees of tightness (i.e., distance from the top of the housing 110 to the cap 130). Thus, if the gasket 180 cannot be compressed enough for the projections 161 to be received in the vertical section corresponding to the tightest configuration of the cap 130, the cap 130 can still be secured to the light fixture with one of the vertical sections corresponding to a looser configuration of the cap 130. In alternative embodiments, the projections 161 can be providing directly on the housing 110 rather than the parts retainer flange 160. In alternative embodiments, the intermediate sections 131*b* can extend at a different angle, e.g. horizontal, from the first vertical sections 131*a*.

Although embodiments described herein are made with reference to example embodiments, it should be appreciated by those skilled in the art that various modifications are well within the scope and spirit of this disclosure. Therefore, the scope of the example embodiments is not limited herein. The disclosure is intended to include all such modifications and alterations disclosed herein or ascertainable herefrom by persons of ordinary skill in the art without undue experimentation.

The invention claimed is:

1. A light fixture comprising:

a housing;

a lens position atop of and coupled to the housing; and a cap for securing the lens to the housing, wherein the cap secures the lens to the housing via locking channels in the cap that are configured to receive and retain projections that are coupled to the housing, and wherein the locking channels having locking positions that receive said projection to secure the lens to the housing.

2. The light fixture of claim 1, further comprising a gasket positioned between the cap and the housing, wherein the gasket biases the cap such that the projections are secured in place within the locking channel.

3. The light fixture of claim 1, wherein the locking channels include a first vertical section, a horizontal section, and a second vertical section through which the projections travel when securing the cap onto the housing.

4. The light fixture of claim 1, wherein locking channels each have a first section having an opening to a bottom of the cap.

5. The light fixture of claim 2, wherein the gasket biases the cap away from the openings of the locking channels.

6. The light fixture of claim 2, wherein the gasket biases the projections to remain in the locking positions.

7. The light fixture of claim 2, wherein the gasket is coupled to the lens.

8. The light fixture of claim 7, wherein the lens includes a lip that is received within the gasket.

9. A light fixture comprising:

a housing;

a lens position atop of and coupled to the housing;

a cap for securing the lens to the housing; and a parts retainer flange positioned between the cap and the housing, wherein the cap secures the lens to the housing via locking channels in the cap that are configured to receive and retain projections that are coupled to the housing.

10. The light fixture of claim 9, wherein the parts retainer flange includes the projections.

11. The light fixture of claim 10, wherein the parts retainer flange is attached to a top portion of the housing.

12. The light fixture of claim 9, wherein the gasket sits atop the parts retainer flange.

13. The light fixture of claim 1, further comprising a light positioned to transmit light through the lens.

14. The light fixture of claim 13, wherein the light is connected to a circuit card supported within the housing.

15. The light fixture of claim 14, wherein the circuit card is connected to a bracket that sits atop a parts retainer flange.

16. The light fixture of claim 1, further comprising a parts retainer flange coupled to the housing; and an electronic component supported by the parts retainer flange, wherein the electronic component extends partially into the lens and partially into the housing.

17. The light fixture of claim 16, further comprising a bracket secured to the electronic component, wherein the bracket rests on top of the parts retainer flange and the electronic component at least partially extends through a central opening in the parts retainer flange.

18. A light fixture comprising:

a housing;

a lens position atop of and coupled to the housing; and a cap for securing the lens to the housing, the housing having an end portion open to an interior cavity, and a frangible coupling secured to the end portion of the housing, wherein the cap secures the lens to the housing via locking channels in the cap that are configured to receive and retain projections that are coupled to the housing.

19. The light fixture of claim 18, wherein the frangible coupling includes a fracture point configured to break when exerted on by an external force, and wherein the interior cavity includes an inner ring at a position corresponding to the fracture point to facilitate breaking of the frangible coupling at the fracture point.

* * * * *